US011805346B1

(12) United States Patent
Kincart

(10) Patent No.: US 11,805,346 B1
(45) Date of Patent: Oct. 31, 2023

(54) PILOT MICROPHONE COVER FOR REDUCING AMBIENT NOISE

(71) Applicant: Robert Landen Kincart, Lakeland, FL (US)

(72) Inventor: Robert Landen Kincart, Lakeland, FL (US)

( * ) Notice: Subject to any disclaimer, the term of this patent is extended or adjusted under 35 U.S.C. 154(b) by 0 days.

(21) Appl. No.: 17/674,027

(22) Filed: Feb. 17, 2022

(51) Int. Cl.
*H04R 1/08* (2006.01)
*H04R 1/32* (2006.01)

(52) U.S. Cl.
CPC ..... *H04R 1/083* (2013.01); *H04R 1/326* (2013.01); *H04R 2410/07* (2013.01)

(58) Field of Classification Search
CPC .. H04R 1/086; H04R 1/2876; H04R 2499/13; H04R 5/033; H04R 1/1083; H04R 1/08; H04R 1/326; H04R 2410/07; H04M 1/03
USPC ..... 381/359, 361, 376, 375, 344
See application file for complete search history.

(56) References Cited

U.S. PATENT DOCUMENTS

| | | | | |
|---|---|---|---|---|
| 7,062,059 | B1 * | 6/2006 | Bobisuthi | H04R 1/083 381/370 |
| 8,019,109 | B2 * | 9/2011 | Gollbach | H04R 1/086 381/357 |
| 9,843,861 | B1 * | 12/2017 | Termeulen | H04R 1/1016 |
| 2007/0003095 | A1 * | 1/2007 | Slamka | H04R 1/086 381/381 |
| 2009/0176538 | A1 * | 7/2009 | Dunn | H04R 1/1058 455/569.1 |
| 2012/0250927 | A1 * | 10/2012 | Ring | H04R 3/005 381/359 |

* cited by examiner

*Primary Examiner* — Norman Yu
(74) *Attorney, Agent, or Firm* — Kyle A. Fletcher, Esq.

(57) ABSTRACT

The pilot microphone cover for reducing ambient noise comprises an enclosure, an audio aperture, and a pair of sound redirection ridges. The pilot microphone cover may attenuate ambient noise to reduce interference with voice communication within a cockpit of an airplane. The pilot microphone cover may be used for anyone who wears a headset in a high wind environment, including but not limited to, ground support, staff, crew, etc. The enclosure may be adapted to cover a microphone of a headset. The enclosure may block the ambient noise while allowing the microphone to pick up sounds that originate in front of the microphone and that enter the enclosure through the audio aperture. The pair of sound redirection ridges may further attenuate the ambient noise originating above and below the microphone.

18 Claims, 4 Drawing Sheets

PILOT MICROPHONE COVER FOR REDUCING AMBIENT NOISE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of aircraft microphone ambient noise reduction systems, more specifically, a pilot microphone cover for reducing ambient noise.

SUMMARY OF INVENTION

The pilot microphone cover for reducing ambient noise comprises an enclosure, an audio aperture, and a pair of sound redirection ridges. The pilot microphone cover may be used for anyone who wears a headset in a high wind environment, including but not limited to, ground support, staff, crew, etc. The pilot microphone cover may attenuate ambient noise to reduce interference with voice communication within a cockpit of an airplane or other location where ambient noise poses a problem. The enclosure may be adapted to cover a microphone of a headset. The enclosure may block the ambient noise while allowing the microphone to pick up sounds that originate in front of the microphone and that enter the enclosure through the audio aperture. The pair of sound redirection ridges may further attenuate the ambient noise originating above and below the microphone.

An object of the invention is to provide a microphone cover to cover the microphone of a headset.

Another object of the invention is to reduce the amount of ambient noise that reaches the microphone.

A further object of the invention is to provide a pair of ridges—one below an audio aperture and one above the audio aperture—to further reduce ambient noise arriving from above and below the microphone.

Yet another object of the invention is to provide a microphone aperture such that the microphone may slide into the enclosure of the microphone cover.

These together with additional objects, features and advantages of the pilot microphone cover for reducing ambient noise will be readily apparent to those of ordinary skill in the art upon reading the following detailed description of the presently preferred, but nonetheless illustrative, embodiments when taken in conjunction with the accompanying drawings.

In this respect, before explaining the current embodiments of the pilot microphone cover for reducing ambient noise in detail, it is to be understood that the pilot microphone cover for reducing ambient noise is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pilot microphone cover for reducing ambient noise.

It is therefore important that the claims be regarded as including such equivalent construction insofar as they do not depart from the spirit and scope of the pilot microphone cover for reducing ambient noise. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
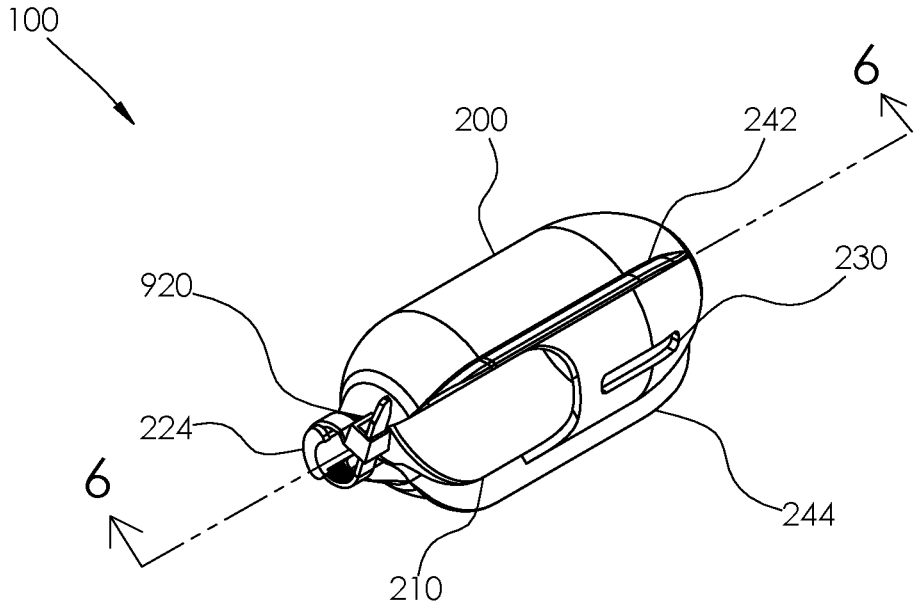
FIG. 1 is an isometric view of an embodiment of the disclosure.
Figure 2:
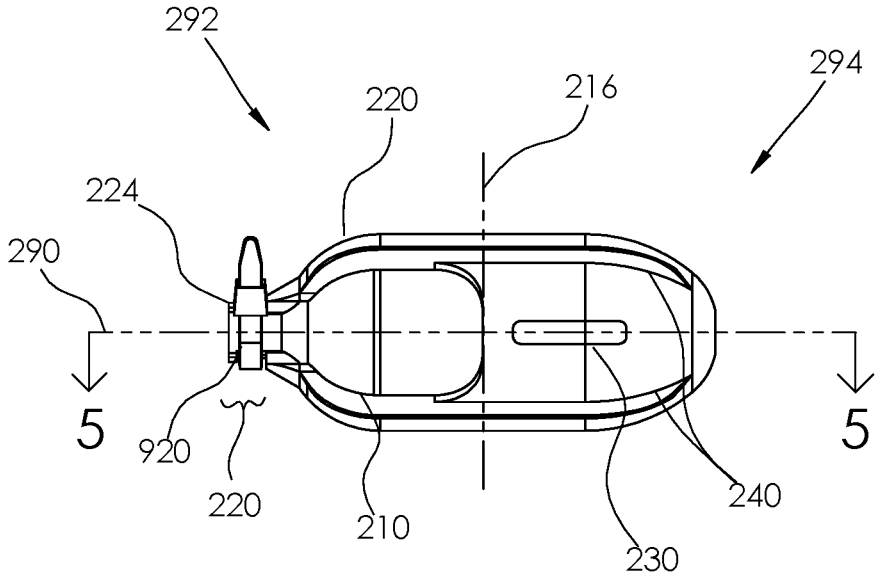
FIG. 2 is a front view of an embodiment of the disclosure.
Figure 3:
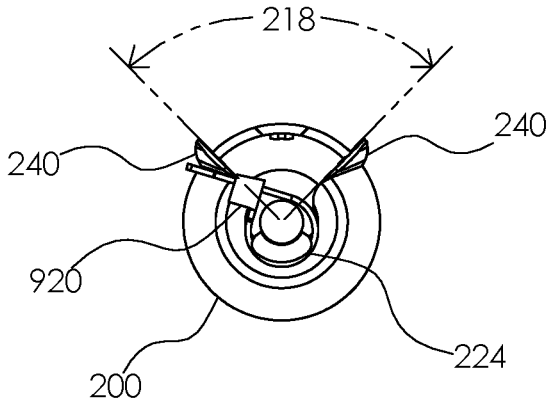
FIG. 3 is a proximal end view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 7.

The pilot microphone cover for reducing ambient noise 100 (hereinafter invention) comprises an enclosure 200, an audio aperture 230, and a pair of sound redirection ridges 240. The invention 100 may attenuate ambient noise to reduce interference with voice communication within a cockpit of an airplane. The enclosure 200 may be adapted to cover a microphone 910 of a headset 900. The enclosure 200 may block the ambient noise while allowing the microphone 910 to pick up sounds that originate in front of the microphone 910 and that enter the enclosure 200 through the audio aperture 230. The pair of sound redirection ridges 240 may further attenuate the ambient noise originating above and below the microphone 910.

The enclosure 200 may be a hollow, capsule-shaped shell that is sized to hold the microphone 910 within the hollow interior of the enclosure 200. The enclosure 200 may block the ambient noise from reaching the microphone 910 from any direction except the front. The enclosure 200 may comprise a microphone aperture 210 through which the microphone 910 may pass when covering and uncovering the microphone 910.

The microphone aperture 210 may be located on the front side of the enclosure 200. The microphone aperture 210 may extend from a proximal end 292 of the enclosure 200 to a longitudinal midpoint 216 of the enclosure 200. The microphone aperture 210 may subtend an angle 218 measured from a longitudinal centerline 290 of the enclosure 200.

The enclosure 200 may comprise a boom collar 220. The boom collar 220 may be a hollow cylinder having an outside diameter that is smaller than the outside diameter of the enclosure 200. The boom collar 220 may project longitudinally from the proximal end 292 of the enclosure 200. The inside diameter of the boom collar 220 may be larger than the outside diameter of a boom 912 on the headset 900 such that the boom 912 may fit within the boom collar 220. The proximal end 292 of the boom collar 220 may terminate with a lip 224 which may be a flange surrounding the proximal end 292 of the boom collar 220. The microphone aperture 210 may extend to the boom collar 220 and the lip 224. The boom collar 220 and the lip 224 may, therefore, be missing a sector through which the boom 912 of the microphone 910 may pass into the boom collar 220. The word collar of the boom collar 220 is being used to refer to the fact that a portion, albeit small, of the boom 912 is covered by the boom collar 220.

A fastener 920 may be used to secure the boom collar 220 to the boom 912 in order to prevent the boom 912 from slipping out of the boom collar 220. The fastener 920 is depicted in the patent figures as a Zip tie. However, the term fastener 920 is being used to refer to a plurality of fastening devices, which may include a specially designed clip. The patent figures depict the use of the lip 224 to retain the fastener 920 on the boom collar 220.

The audio aperture 230 may be an aperture on the front of the enclosure 200. The audio aperture 230 may be located between the microphone aperture 210 and a distal end 294 of the enclosure 200. The audio aperture 230 may be adapted to allow the voice of a pilot 950 to pass through the enclosure 200 to reach the microphone 910. In a preferred embodiment, the audio aperture 230 may be a longitudinal slot.

Note that the voice of the pilot 950 may also reach the microphone 910 by entering the enclosure 200 through the microphone aperture 210 which is also located on the front of the enclosure 200 and this is acceptable. The audio aperture 230 and the microphone aperture 210 may be adapted to facilitate the voice reaching the microphone 910 while the remainder of the enclosure 200 blocks the ambient noise.

The pair of sound redirection ridges 240 may be sound barriers to attenuate the ambient noise originating above and below the enclosure 200 by blocking the path from the ambient noise to the audio aperture 230 on the front of the enclosure 200. The pair of sound redirection ridges 240 may project radially away from the longitudinal centerline 290 of the enclosure 200. An upper ridge 242 may be oriented longitudinally above the audio aperture 230 and a lower ridge 244 may be oriented longitudinally below the audio aperture 230.

The pair of sound redirection ridges 240 may extend from the proximal end 292 of the enclosure 200 to the distal end 294 of the enclosure 200 such that the audio aperture 230 and the majority of the microphone aperture 210 lie between the upper ridge 242 and the lower ridge 244. The portion of the microphone aperture 210 that does not lie between the upper ridge 242 and the lower ridge 244 may largely be located on the boom collar 220 and the lip 224 in areas that may be closed off by the presence of the boom 912.

Figure 4:
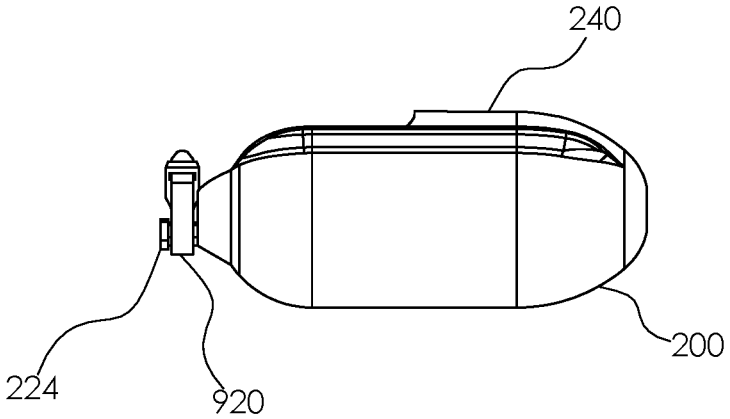
FIG. 4 is a side view of an embodiment of the disclosure.
Figure 5:
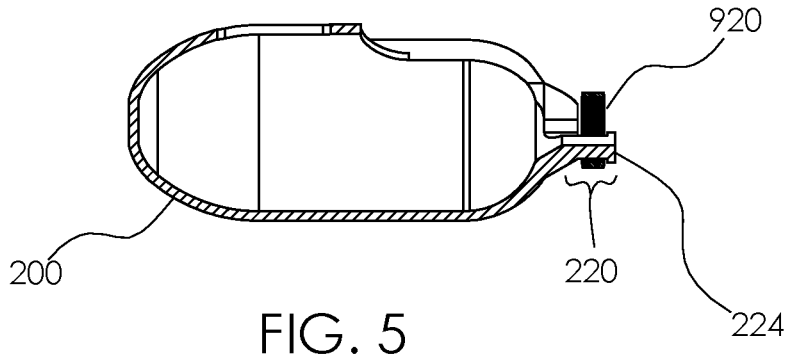
FIG. 5 is a cross-sectional view of an embodiment of the disclosure across 5-5 as shown in FIG. 2.
Figure 6:
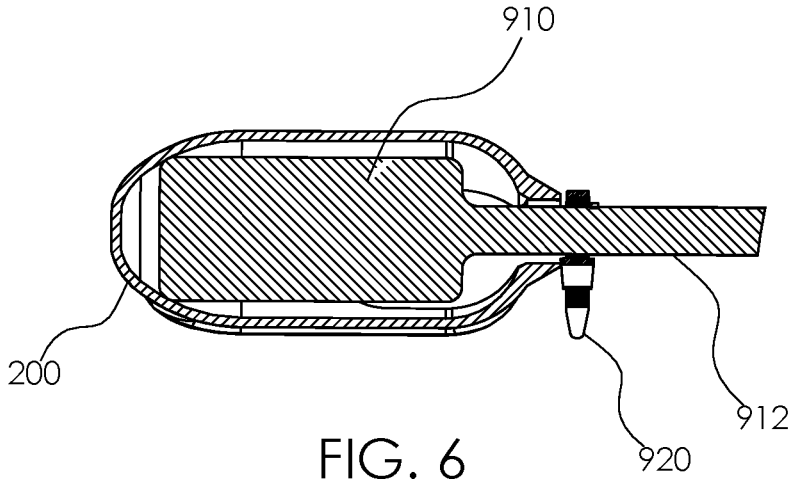
FIG. 6 is a cross-sectional view of an embodiment of the disclosure across 6-6 as shown in FIG. 1.
Figure 7:
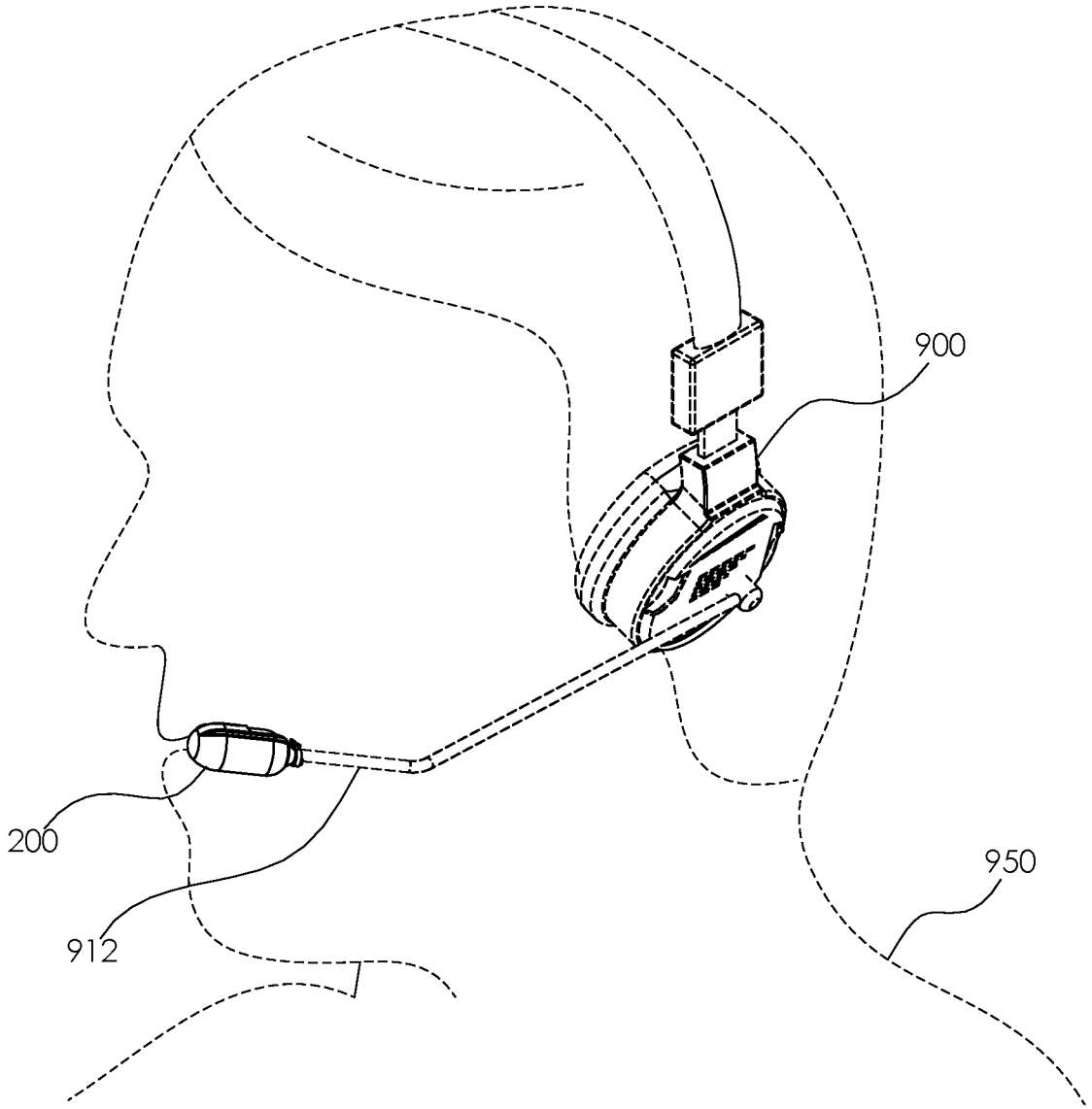
FIG. 7 is an in-use view of an embodiment of the disclosure.

Moreover, the pair of sound redirection ridges 240 may be further referred to as at least one sound redirection ridge 2400 (see FIG. 4). The at least one sound redirection ridges 240 may be located above, below, above and below, or at other locations surrounding the microphone aperture 210.

In some embodiments, the pair of sound redirection ridges 240 may project radially away from the enclosure 200 such that any straight line drawn from the outermost edge of the upper ridge 242 to the outermost edge of the lower ridge 244 does not pass through the enclosure 200.

In use, an enclosure 200 may be placed onto the microphone 910 by inserting the microphone 910 into the microphone aperture 210 and then pressing the boom collar 220 against the boom 912. The enclosure 200 may be oriented such that the audio aperture 230 faces the pilot 950. A fastener 920 may secure the boom 912 to the boom collar 220 and the lip 224 may prevent the fastener 920 from sliding off of the boom collar 220. With the enclosure 200 in place, the microphone 910 may pick up the voice of the pilot 950 originating in front of the microphone 910 but may be shielded from the ambient noise originating elsewhere within the cockpit.

It is envisioned that the invention 100 may include a dampening member (not depicted), which would be placed inside of the enclosure in order to abate vibrations associated with the use of the claimed device 100 and the microphone 910. The dampening member (not depicted) may be constructed of a foam, an item of fabric, textile, or other material.

In addition to the pilot 950, the invention 100 may be placed on the microphones 910 of other mic'd people in the airplane such as a co-pilot, flight crew, passengers, or any combination thereof. Moreover, the pilot 950 may be referred to as an end user. For purposes of the claims listed below, the pilot 950 may be interchanged with the end user 950 in order to not limit the scope of the patent to one particular location or individual using the claimed device. It shall be further noted that the claimed device may be used in other locations, not limited to an airplane, much less a cockpit.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used in this disclosure, a "cable tie"—also called a zip tie—may be a type of fastener that is used to hold two objects together. The cable tie has a box end and a straight end. The straight end comprises a series of teeth. The box end further comprises a pawl wherein when the straight end is inserted into the box end, the pawl engages the teeth to prevent the straight end from being removed from the box end. Cable ties may be commonly made of nylon.

As used herein, "capsule-shaped" may refer to a structure that resembles a cylinder capped one either end by hemisphere.

As used in this disclosure, the "centerline" may be an imaginary line that defines the center of one or more cross sections of an object. Unless stated otherwise, the centerline follows a longitudinal path through the object at the center of lateral cross sections. If the object is tubular, the centerline follows the center of the tube.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "flange" may be a protruding rib, edge, or collar that is used to hold an object in place or to attach a first object to a second object.

As used herein, "inside diameter" or "inner diameter" may refer to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, the word "interior" may be used as a relational term that implies that an object is located or contained within the boundary of a structure or a space.

As used herein, the word "longitudinal" or "longitudinally" may refer to a lengthwise or longest direction.

As used herein, "mic'd" (alternatively "miked") may refer to wearing a microphone.

As used in this disclosure, a "microphone" may be a transducer that converts the energy from vibration into electrical energy. The sources of vibrations include, but are not limited to, acoustic energy.

As used here, the word "midpoint" may refer to a point that is between the ends of an object. An "exact midpoint" may refer to a midpoint that is equidistant from edges of the object in at least one direction. Unless otherwise stated, a midpoint is not required to be at the exact center of the object but instead may be separated from the exact midpoint by up to 50% of the distance from the exact midpoint to the farthest edge, farthest end, or farthest corner.

As used herein, "outside diameter" or "outer diameter" may refer to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, a "ridge" may be an elevated or raised portion of a structure.

As used in this disclosure, a "slot" may be a narrow groove, cut, opening, or aperture that is formed in or through an object.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A microphone cover for reducing ambient noise comprising:

an enclosure, and an audio aperture;

wherein the microphone cover for reducing ambient noise attenuates ambient noise to reduce interference with voice communication;

wherein the enclosure is adapted to cover a microphone of a headset in order to block ambient noise while allowing the microphone to pick up sounds that originate in front of the microphone and that enter the enclosure through the audio aperture;

wherein the enclosure is adapted to block ambient noise from reaching the microphone from any direction except the front;

wherein the enclosure is further defined with a pair of sound redirection ridges;

wherein the pair of sound redirection ridges further attenuate the ambient noise originating above and below the microphone.

2. The microphone cover for reducing ambient noise according to claim 1 wherein the enclosure is a hollow, capsule-shaped shell that is sized to hold the microphone within the hollow interior of the enclosure.

3. The microphone cover for reducing ambient noise according to claim 2 wherein the enclosure comprises a microphone aperture through which the microphone passes when covering and uncovering the microphone.

4. The microphone cover for reducing ambient noise according to claim 3 wherein the microphone aperture is located on the front side of the enclosure.

5. The microphone cover for reducing ambient noise according to claim 4 wherein the microphone aperture extends from a proximal end of the enclosure to a longitudinal midpoint of the enclosure.

6. The microphone cover for reducing ambient noise according to claim 5 wherein the at least one sound redirection ridge is positioned adjacent to the microphone aperture.

7. The microphone cover for reducing ambient noise according to claim 6 wherein the enclosure comprises a boom collar;

wherein the boom collar is a hollow cylinder having an outside diameter that is smaller than the outside diameter of the enclosure;

wherein the boom collar projects longitudinally from the proximal end of the enclosure.

8. The microphone cover for reducing ambient noise according to claim 7 wherein an inside diameter of the boom collar is larger than an outside diameter of a boom on the headset such that the boom fits within the boom collar.

9. The microphone cover for reducing ambient noise according to claim 7 wherein the proximal end of the boom collar terminates with a lip which is a flange surrounding the proximal end of the boom collar.

10. The microphone cover for reducing ambient noise according to claim 8 wherein the microphone aperture extends to the boom collar and the lip;

wherein the boom collar and the lip are missing a sector through which the boom of the microphone passes into the boom collar.

11. The microphone cover for reducing ambient noise according to claim 9 wherein a fastener is used to secure the boom collar to the boom in order to prevent the boom from slipping out of the boom collar;

wherein the lip retains the fastener on the boom collar.

12. The microphone cover for reducing ambient noise according to claim 10 wherein the audio aperture is an aperture on the front of the enclosure;

wherein the audio aperture is located between the microphone aperture and a distal end of the enclosure.

13. The microphone cover for reducing ambient noise according to claim 11 wherein the audio aperture is adapted to allow the voice of an end user to pass through the enclosure to reach the microphone.

14. The microphone cover for reducing ambient noise according to claim 12 wherein the audio aperture is a longitudinal slot.

15. The microphone cover for reducing ambient noise according to claim 12 wherein the pair of sound redirection ridges are sound barriers to attenuate the ambient noise originating above and below the enclosure by blocking the path from the ambient noise to the audio aperture on the front of the enclosure.

16. The microphone cover for reducing ambient noise according to claim 14 wherein the pair of sound redirection ridges project radially away from the longitudinal centerline of the enclosure.

17. The microphone cover for reducing ambient noise according to claim 15 wherein an upper ridge is oriented longitudinally above the audio aperture and a lower ridge is oriented longitudinally below the audio aperture.

18. The microphone cover for reducing ambient noise according to claim 16 wherein the pair of sound redirection ridges extend from the proximal end of the enclosure to the distal end of the enclosure such that the audio aperture and the majority of the microphone aperture lie between the upper ridge and the lower ridge;

wherein the pair of sound redirection ridges project radially away from the enclosure such that any straight line drawn from the outermost edge of the upper ridge to the outermost edge of the lower ridge does not pass through the enclosure.

* * * * *